United States Patent [19]

Bernhard

[11] 3,964,206

[45] June 22, 1976

[54] MINIATURE VEHICLE WITH MAGNETIC FORCE

[75] Inventor: Robert Bernhard, Hollywood, Calif.

[73] Assignee: Aurora Products Corporation, West Hempstead, N.Y.

[22] Filed: Feb. 3, 1975

[21] Appl. No.: 546,523

[52] U.S. Cl. ..... 46/251; 46/202; 46/206

[51] Int. Cl.[2] ..... A63H 33/26

[58] Field of Search ..... 46/243 R, 243 LV, 243 P, 46/206, 236, 234, 202

[56] References Cited

UNITED STATES PATENTS

| | | | |
|---|---|---|---|
| 3,243,917 | 4/1966 | Giammarino et al. | 46/243 P |
| 3,486,271 | 12/1969 | Feikema | 46/243 P |
| 3,810,515 | 5/1974 | Ingro | 46/243 LV X |

*Primary Examiner*—Louis G. Mancene
*Assistant Examiner*—Jack Q. Lever
*Attorney, Agent, or Firm*—Amster & Rothstein

[57] ABSTRACT

A miniature electrically powered vehicle including an electric motor having a pair of permanent magnets mounted in the car to serve as the stator of the motor and also being mounted to extend in close magnetic proximity to the electric rails positioned in the track upon which the vehicle is operated. The magnets are mounted one behind the other in the vehicle such that a magnetic flux path exists running between one of the permanent magnets to at least one of the electric rails and then to the other of said permanent magnets. The resulting magnetic force between the car and the track provides an increased normal force of the car against the track to increase the traction of the driving wheels and to decrease slippage and prevent the vehicle from spinning as it negotiates curves in the track.

11 Claims, 4 Drawing Figures

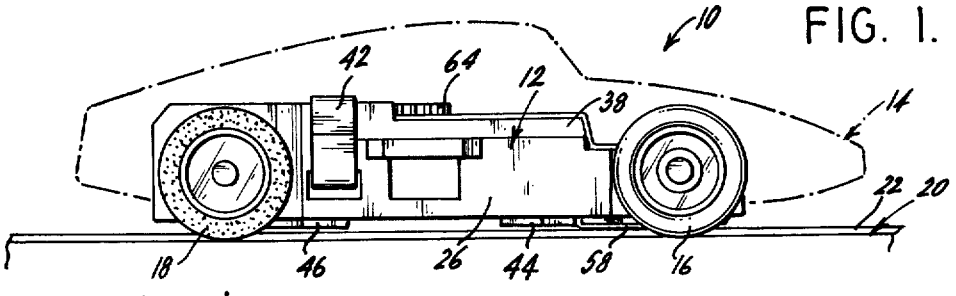
FIG. 1.
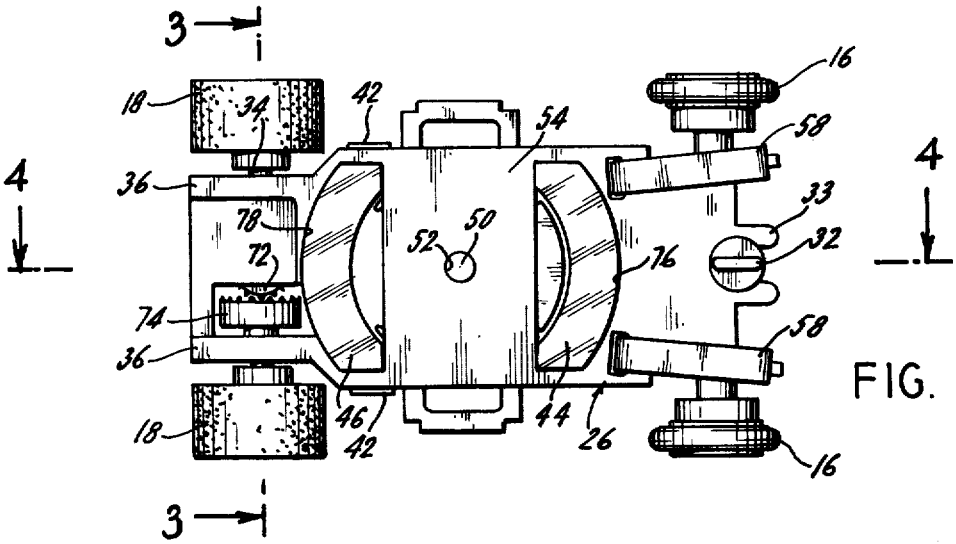
FIG. 2.
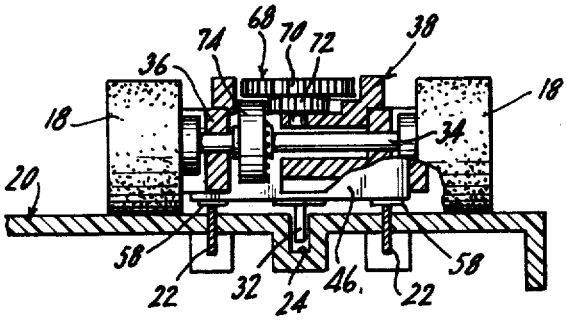
FIG. 3.
FIG. 4.
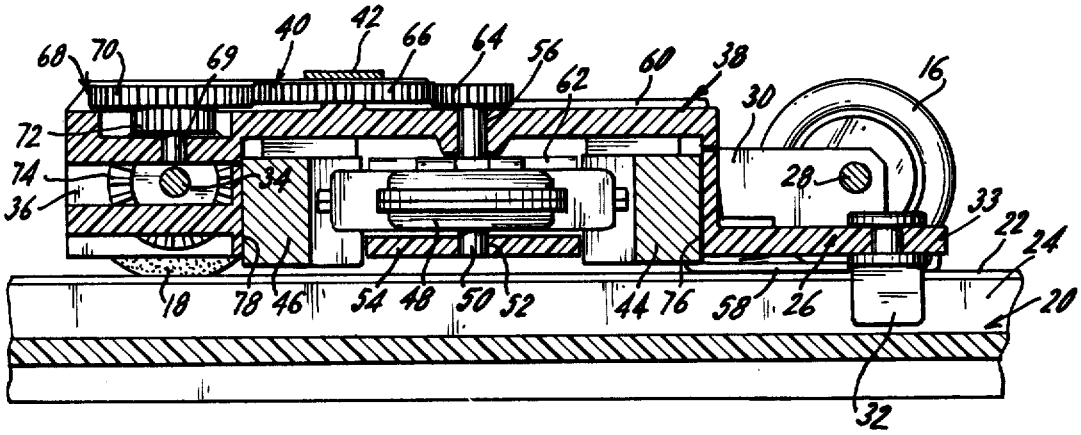

MINIATURE VEHICLE WITH MAGNETIC FORCE

The present invention relates generally to miniature, electrically powered vehicles which are traditionally used as toys in association with a continuous track which has at least one pair of electrical rails embedded in it. The vehicle has a pair of pick-up shoes which engage the pair of tracks, thereby delivering electric power to the motor of the vehicle. Such cars are depicted in prior patents including, for example, the patent issued to G. E. Giammarino et al., U.S. Pat. No. 3,243,917 issued on Apr. 5, 1966 and entitled Electrical Motor-Operated Toy Vehicle. In vehicles of this type, a guide pin or other protrusion is normally provided at the forward end of the car and extends down below the level of the front wheels of the car. The guide pin is engaged within a guide slot in the track and serves to steer the car through the intended course around the track. The electrical rails are embedded in the track on either side of the slot and complementary pick-up shoes are positioned on either side fo the guide pin in the car in order to make electrical sliding contact with the rails as the car moves around the track. The track may have several such slots so that several cars can be operated at the same time.

In some instances, such cars operate without a guide pin and the tracks they operate on are provided with multiple pairs of electrical rails such that the pick-up shoes are substantially continuously engaged with one or another pair of rails along with the width of the track; such products shown, for example, in U.S. Pat. No. 3,486,271, entitled Model Car and Track System, which was issued to R. Feikemer on Dec. 30, 1969.

Although products of this general type have been successfully manufactured and marketed, there have been a number of problems which have long existed but which have not heretofore been fully solved. Among the most significant of these problems is: the insufficient traction force which has allowed the wheels of such electrically powered vehicles to needlessly spin on attempted acceleration and thereby to lose a great deal of their speed; and also, the problem of spinning out on curves. This is due to the necessary low weight of these products. These problems have been helped a great deal by the use of larger rear tires of soft material such as foam, plastic or rubber as opposed to the harder rubber-like tires which had been used. Although the soft and wide tires have produced some improvement in operation of the cars, the low traction and spin problems have continued.

It has been clear to those skilled in this art that increasing the weight of the vehicle would increase the normal force of a vehicle against the track, thereby increasing the frictional forces or traction forces between the vehicle wheels and the track surface. However, the simple expedient of adding weight to the toy vehicle is an unsuccessful alternative because for each increment of additional weight added to the vehicle, it is required to add additional motive power, i.e., it is required to provide a bigger and/or stronger motor. Not only does this requirement increase the cost of the end product, it is often impossible to have any substantial increase in the power of the motor because of the extremely small size of the vehicles which, in their preferred embodiments, are approximately HO gauge. It has also been known that one could increase the normal force exerted by a car riding upon an iron or steel surface by mounting permanent magnets on the car at a location close enough to the surface such that they would form a magnetic attraction, thereby increasing the effective normal force on the car, i.e., by making the normal force the sum of the weight plus the magnetic attraction. This expedient, however, has never proved successful because the weight of the magnets pose the same need for increased power as was required for normal weight increases, and the costs of additional magnetic material exceed the benefits to be derived. It is in this environment, that applicant's invention was conceived.

It is among the objects of the present invention to provide an improved electrically operated miniature toy vehicle for use on a track which has magnetic material in the track. Generally, it is the intention of the present invention to provide an improved toy vehicle for use on conventional tracks having steel electrical rails embedded in it. More specifically, it is an object of the present invention to provide an improved toy vehicle for use on conventional tracks having steel electrical rails embedded in it. More specifically, it is an object of the present invention to provide an improved electrically operated toy vehicle which has increased normal forces as compared with conventional vehicles of this type but without any increase in the weight or mass of the toy vehicle.

Applicant has provided a solution to the prior art problems discussed above by incorporating the stationary permanent magnets of the vehicle motor in such a position and location that they form a magnetic link with the electrical rails in the track for the vehicle, thereby increasing the normal force without increasing the mass of the vehicle or the cost of producing the vehicle. Specifically, in accordance with the present invention, there is an improved miniature electrically powered vehicle for use on a conventional track having electrical pick-up rails in the tracks. A pair of permanent magnets mounted one toward the front and one toward the rear of the vehicle are mounted in position to serve as the stator of the motor and are also mounted such that they extend downwardly from the bottom of the vehicle to be closely adjacent to the plane which is defined by the bottom of the wheels of the vehicle such that they are in close magnetic proximity to the electrical rails. A path of magnetic flux exists from one magnet to the electric rails and from the electric rails to the other magnet thereby creating a magnetic normal force tending to hold the miniature vehicle down on the track and thereby increasing the traction forces and the anti-slip or spin forces existing between the vehicle wheels and the surface of the track.

The above brief description, as well as further objects, advantages and features of the present invention, will be best appreciated by reference to the following description when taken in conjunction with the accompanying drawings, wherein:

FIG. 1 is a side view of the chassis of a miniature vehicle in accordance with the present invention showing the chassis in full line and an outline of the car body in phantom lines;

FIG. 2 is a bottom view of the chassis shown in FIG. 1 looking at the chassis from below;

FIG. 3 is a sectional view taken along the line 3—3 of FIG. 2 looking in the direction of the arrows showing the specific location of the permanent magnets within the car chassis and the magnets' relationship to the electrical rails; and FIG. 4 is a sectional view taken along the line 4—4 along the central axis of the chassis, looking in the direction of the arrows and further illustrating the relationship of the pair of magnets to the electrical rails as well as the relationship of the magnets in their role as the stationary portion of the electric motor and also illustrating the functions of the power drive train running from the armature of the motor through the gear system to the rear axle of the car.

Referring now generally to the drawings, there is shown a toy vehicle generally designated by the numeral 10 which comprises a chassis assembly 12 onto which is fitted a body 14 which may be of any desired configuration. The car 10 rides on front wheels 16 and rear wheels 18 on a track 20, the surface of which is interrupted by a pair of electrical rails 22 and a continuous slot 24 (see FIG. 3).

The chassis 12 of the car 10 includes a main frame 26 onto which are mounted the other elements of the chassis 12. Specifically, the front wheels 16 are mounted on an axle 28 which is positioned in a pair of bosses 30 extending to the front of the car. The guide pin 32 is mounted on a forward extension 33 of the frame 26 by means of a double-headed attachment portion for the guide pin 32 as shown in FIGS. 2 and 4. The rear wheels 18, which are of a wide configuration and covered with foam material which has a high coefficient of friction, are mounted on a rear axle 34 which is journaled in a pair of rearwardly extending bosses 36 (see FIGS. 2 and 3). A cover plate assembly 38, which carries a drive gear train 40, is mounted on top and held in place by a clip spring 42. The front motor magnet 44 and the rear motor magnet 46 are mounted within the main frame 26 as will be described in greater detail below. The motor armature 48 assembly and its armature shaft 50 are mounted for rotational movement in the chassis 12 with bottom end of the armature shaft 50 contained within a bearing opening 52 in a cross member 54 of the main frame 26 and the upper end of the shaft 50 contained within a bearing opening 56 in the cover plate 38. The armature assembly 48 and the stationary magnets 44, 46 combine to form the main elements of the electric motor which drive the vehicle. Power is delivered to the electric motor through conventional means comprising the two articulated pick-up shoes 58 which are electrically connected to conductors 60 on the top of the cover 38 which engage conventional spring-loaded graphite brushes (not shown for clarity) which extend downwardly from the cover 38 and engage the commutator 62 which is mounted on shaft 50 in the armature assembly 48. An analogous construction is illustrated in the Giammarino et al. patent, U.S. Pat. No. 3,243,917.

The gear drive train 40 from the motor extends through its shaft 50 to a first pinion gear 64 which is fixed to the shaft 50 above the upper level of the cover plate 38. A second pinion gear 66 is pivoted on a pin formed on the top of the cover plate 38 and rotates in a direction opposite to pinion 64. The pinion gear 66 is held in place by the clip spring 42. A double pinion gear 68 is mounted for rotational movement on pin 69 which is fixed to the cover plate 38 as shown in FIGS. 3 and 4. The upper and larger gear 70 of the double unit 68 is engaged with the pinion gear 66 and it, in turn, drives the smaller gear 72. Gear 72 is engaged with a crown gear 74 which, in turn, is fixed to and drives the rear axle 34. Thus, upon rotation of the armature 48, the first small gear 64 is driven at a relatively high speed and that speed is geared down by passage through the gear train 64, 66, 70, 72 and 74, delivering rotational power to the rear wheels 18.

The magnets 44 and 46 are mounted respectively in wells 76 and 78 formed in the bottom of the chassis frame 26. Each of the magnets is a portion of an annulus and the outer walls of the wells 76, 78 are cylindrical to conform to the outer cylindrical wall of the respective magnet. The inner cylindrical walls of the magnets 44, 46 define a cylindrical opening which is complementary in diameter to the diameter of the armature 48. The relationship between the magnets 44, 46 and the armature 48 is conventional and remains the same as existed in the prior art as exemplified in the Giammarino et al. patent referred to above. However, in accordance with the present invention, the magnets 44, 46 are positioned effectively lower than existed in the prior art and are spaced very close to the tops of the electrical rails 22. As a result, a magnetic flux path is created between the magnets 44, 46 through the electric rails 22. This produces a magnetic attractive force between the magnets and the track 20 thus effectively increasing the normal force of the car 10, through its wheels 16, 18, onto the track. The spacing between the magnets 44, 46 and the tops of the rails 22 is maintained as close as is practical without producing scraping and actual contact, and it has been found that an advantageous desired result is produced in accordance with the present invention when the magnet-electrical rail spacing is approximately 0.020 inches.

It will be appreciated that upon increase of the normal force of the car 10 upon the track 20, the effective traction and anti-sliding characteristics of the car 10 is increased. The frictional force of the wheels 16, 18 on the track 20 is defined by the product of the coefficient of friction between the surfaces of the wheels on the track multiplied by the normal force between the particular wheel and the track. Obviously, the normal force (when the car is running on a straightaway) is the force of gravity acting on the mass of the car plus that additional normal force resulting from the magnetic attraction between the magnets 44, 46 and the rails 22. There is, effectively, no increased requirement for power as a result of the increased normal force produced by the magnetic attraction. The increased friction in the wheel bearings is negligible. If one were to increase the normal force by adding weight to the car, either a more powerful motor would be required or acceleration would be decreased. However, by using the present invention, there is an increase in normal force with no increase in mass at all, and the acceleration remains the same without any increase in the power of the motor. In fact, the effective acceleration increases because there is less slippage between the driving wheels and the surface of the track.

Those skilled in the art will appreciate that the construction in accordance with the present invention provides a greatly improved performance with essentially no increase in cost and with no increased difficulty in manufacture. The permanent magnets for the motor are mounted in such a manner as to be within close magnetic proximity to the ferrous materials in the track rails, thereby to cause magnetic attraction between the magnets of the car and the rails. As a result, the normal force is increased thereby improving the traction and anti-spin characteristics of a miniature electrically powered vehicle. Persons skilled in the art will appreciate that a variety of different constructions can be designed to incorporate the basic concepts described above.

What I claim is:

1. In a miniature, electrically powered vehicle of the type having an electric motor operatively connected to driving wheels on the vehicle and energized through a pair of electrical pick-up shoes and a track having electric power means therein and engageable with said pick-up shoes, the improvement comprising:

a. a pair of permanent magnets mounted in said vehicle forming the stationary magnetic portions of the electric motor of said vehicle;

b. said pair of magnets extending downwardly to a distance above said power means in the range of approximately 0.00 to approximately 0.02 inches;

c. said electric power means being formed of magnetic material; and d. said magnets and said power means providing a magnetic force urging said vehicle downwardly toward said track to provide increased normal force on said car against said track thereby providing increased driving traction between said wheels and said track.

2. A device in accordance with claim 1 wherein said magnets are located one in front of the other from front to rear of said vehicle.

3. A device in accordance with claim 1 wherein said magnets are arcuate in shape and are mounted in a plane parallel to the plane defined by the bottom of the wheels of said vehicle.

4. A device in accordance with claim 1 wherein the electric power means in said track comprise a pair of rails running lengthwise of said track.

5. A device in accordance with claim 4 wherein said rails extend upwardly from the running surface of said track toward the plane of said magnets.

6. A device in accordance with claim 1 wherein said electric power means provides a magnetic flux bar between said magnets when said vehicle is on said track.

7. A device in accordance with claim 5 wherein said electric power means provides a magnetic flux bar between said magnets when said vehicle is on said track.

8. A device in accordance with claim 1 wherein said vehicle includes a chassis in which said pair of permanent magnets is mounted, said magnets extending to the lower most level of said chassis.

9. In a miniature, electrically powered vehicle of the type having an electric motor operatively connected to driving wheels on the vehicle and energized through a pair of electrical pick-up shoes and a track having electric power means therein and engageable with said pick-up shoes, said vehicle including a supporting chassis, the improvement comprising:

a. a pair of permanent magnets mounted in said chassis forming the stationary magnetic portions of the electric motor of said vehicle;

b. said pair of magnets extending downwardly to the lowermost level of said chassis to a location closely adjacent to the plane defined by the bottom of the wheels of said vehicle and in close magnetic proximity to said electric power means, no portion of said chassis being located between said pair of permanent magnets and said electric power means;

c. said electric power means being formed of magnetic material; and d. said magnets and said power means providing a magnetic force urging said vehicle downwardly toward said track to provide increased normal force on said car against said track thereby providing increased driving traction between said wheels and said track.

10. A device in accordance with claim 8 in which no portion of said chassis is located between said pair of permanent magnets and said electric power means.

11. In a miniature, electrically powered vehicle of the type having an electric motor operatively connected to driving wheels on the vehicle and energized through a pair of electrical pick-up shoes and a track having electric power means therein and engageable with said pick-up shoes, said vehicle including a supporting chassis, the improvement comprising:

a. a pair of permanent magnets mounted in said vehicle forming the stationary magnetic portions of the electric motor of said vehicle;

b. said pair of magnets extending below said chassis and in close proximity to said electric power means;

c. said electric power means being formed of magnetic material; and d. said magnets and said power means providing a magnetic force urging said vehicle downwardly toward said track to provide increased normal force on said car against said track thereby providing increased driving traction between said wheels and said track.

* * * * *